United States Patent [19]

Drechsel

[11] 4,231,522

[45] Nov. 4, 1980

[54] STEP-BY-STEP IRRIGATOR

[76] Inventor: Arno Drechsel, Via Weggenstein No. 29, Bolzano, Italy

[21] Appl. No.: 10,404

[22] Filed: Feb. 8, 1979

[30] Foreign Application Priority Data

Feb. 9, 1978 [IT] Italy ..... 46814 A/78
Sep. 14, 1978 [IT] Italy ..... 46889 A/78

[51] Int. Cl.[3] ..... B05B 3/08

[52] U.S. Cl. ..... 239/233; 188/83; 188/166

[58] Field of Search ..... 239/231, 232, 233, 252; 188/83, 166

[56] References Cited

U.S. PATENT DOCUMENTS

| | | | |
|---|---|---|---|
| 3,195,817 | 7/1965 | Sandie | 239/252 |
| 3,592,388 | 7/1971 | Friedlander | 239/233 |
| 3,744,720 | 7/1973 | Meyer | 239/231 |

FOREIGN PATENT DOCUMENTS

| | | | |
|---|---|---|---|
| 1076772 | 10/1954 | France | 239/231 |
| 64995 | 12/1955 | France | 239/233 |

*Primary Examiner*—Robert B. Reeves
*Assistant Examiner*—Michael J. Forman
*Attorney, Agent, or Firm*—Brisebois & Kruger

[57] ABSTRACT

Step-by-step rotary irrigator with a swinging nose and of the type provided with an inclined propelling tube rotatable on a substantially vertical column, a brake is provided for automatically braking the rotation of the rotatable tube in accordance with the water pressure. Provision is included for adjusting the period of swing of the swinging nose, and there is a double acting deflector for swinging the nose by interference with the water jet and for arresting its swing by interference with the water jet just before it collides against the propelling tube.

12 Claims, 16 Drawing Figures

STEP-BY-STEP IRRIGATOR

This invention relates to a step-by-step irrigator which enables irrigation to be carried out either over a complete circle or over a sector, using the most convenient rotational or covering speed for the type of ground to be irrigated.

Step-by-step irrigators are known, consisting essentially of a water feed column, on the top end of which a propelling tube, the purpose of which is to generate the irrigation jet, is rotatably mounted by way of an adjustable brake. In addition, certain known irrigators carry a nose or arm hinged to said propelling tube, and which can swing in a vertical plane.

The present invention relates to this type of step-by-step irrigator, these being all provided at the front end of the swinging nose with a jet breaking sector, the purpose of which is to break up and deviate the jet, so receiving a thrust which intermittently rotates the propelling tube.

Finally, step-by-step irrigators of known type comprise, on the side of the propelling tube, a device for reversing the rotation of this latter, its free end being provided with a secondary deflector or scoop, the purpose of which is to interfere with the irrigator jet only during the return of the propelling tube.

However, as they are designed and constructed, such irrigators of the aforesaid type have a series of drawbacks which greatly limit their application.

The object of the present invention is to propose and protect an irrigator of the aforesaid type, known commonly as step-by-step, comprising a series of improvements which, both individually and overall, surprisingly increase the versatility and uniformity of operation of the irrigator.

In order to clarify the invention, the operating principles of step-by-step irrigators will be described hereinafter, in order to illustrate the operational limits which derive therefrom.

Step-by-step irrigators derive their rotational movement from partial interference with the water jet, by a main deflector disposed at the end of a nose which swings in a vertical plane, and which could also be called a "mobile arm". This main deflector is partly immersed in the jet, to give rise to a tangential thrust by reaction, which rotates the jet in the opposite direction.

The mobile nose is made to swing in a vertical plane in one direction by a secondary deflector interfering with the jet, and in the opposite direction by a counterweight and/or by resilient return means. Generally, the main and secondary deflectors form part of the same deflector unit.

The resultant average speed of rotation of the irrigator derives firstly from the size of the tangential thrust caused by the main deflector, and secondly by the number of times the main deflector interferes with the jet in one unit of time. Thus, to increase the average speed of rotation of the irrigator:

either the size of the thrust can be increased by increasing the amount by which the main deflector is immersed in the jet, or steepening the positioning of the main deflector, so increasing the extent of each individual rotation or by increasing the number of thrusts per unit of time, i.e. the swinging speed of the mobile nose.

The rotation of the mobile part of the irrigator about its support column is always braked by a brake which can be adjusted from the outside, this being indispensable to allow the irrigator to operate in an inclined position or in a strong wind. In this respect, for example if the brake is not present, the irrigator if inclined would tend always to move by gravity to a line of maximum slope, so cancelling the thrust imparted to it by the main deflector.

One of the limitations to the application of this type of irrigator derives from the fact that due to the manner in which it is designed, in order to operate uniformly it requires a high pressure, generally exceeding 5 atmospheres. If precisely adjusted, this type of known irrigator can also operate at a lower pressure. However, on being adjusted, the range of pressure over which it can properly operate is very narrow, and is of the order of about 2 atmospheres. This means that if these irrigators are set to operate properly starting from 3 atmospheres, when the pressure approaches approximately 5 atmospheres their operation becomes less efficient, and a new adjustment is required. This means that such irrigators are generally set to start from 5 atmospheres, so that they can operate properly at the usual pressure of about 6 atmospheres. The fact that the irrigator does not move uniformly below this set pressure (5 atm.) means that during start-up the water jet does not become interrupted, and either excavates a groove in the field to be irrigated, or damages the crops.

A further drawback encountered with this type of irrigator is the difficulty of adjusting the rotational speed of operation. This difficulty derives from the fact that the rotational thrust transferred to the irrigator for each interference of the deflector with the jet is a function of the operating pressure. Thus, in known irrigators, as the operating pressure increases, the rotational thrust increases, and consequently the angle through which the irrigator rotates for each interference increases, so substantially increasing the average speed of rotation. On the other hand, in the case of pressures less than the set pressure, the irrigator rotates with difficulty, and therefore operates incorrectly, requiring the brake to be adjusted at certain times.

An object of the present invention is to propose a design which allows uniform operation of the irrigator starting at a very low pressure, of the order of about 2 atmospheres, and which also allows the overall rotational thrust transmitted to the irrigator for each interference of the deflector with the jet, to be adjusted and set externally, so that said thrust is constant independent of the pressure.

The thrust can notably be adjusted in order to adapt it to the pressure, by adjusting the inclination and degree of immersion of the main deflector as required. However, this procedure has serious limitations in that for proper operation, said degree of immersion is determined by the diameter of the nozzle used, and therefore if the degree of immersion is varied, the other parameters must also be adjusted. Finally, the degree of immersion can be adjusted only when the jet is not working, so as to avoid serious accidents.

The aforementioned object is attained according to the invention by providing the irrigator with a brake which is automatically adjustable in accordance with the pressure, so that the braking action of said brake automatically increases with pressure, and is algebraically added to the rotational thrust deriving from the interference with the jet by the deflector, to give a resultant thrust which is substantially constant. This is obtained according to the invention by using the sleeve which supports the rotating part of the jet, and is inserted into the fixed column of the irrigator, to receive the upward hydraulic thrust and to unload it against a fixed member which brakes the rotation of the sleeve, and consequently of the rotating part of the jet which is rigid therewith.

In this manner, as the braking action is proportional to the pressure for a given inclination or for a given degree of immersion of the main deflector, as set externally, the overall rotational thrust is independent of the operating pressure, and can also be adjusted as required. This offers the desirable advantage that even at low pressure, uniform rotation of the jet and consequent proper operation are obtained, because the braking action is comparatively low.

Finally, said rotational thrust can be adjusted externally either by varying the degree of immersion of the main deflector in the jet, or by varying the inclination of the main deflector. As the main deflector forms part of a unit to which are generally fitted the secondary deflectors for causing the mobile nose to swing in a vertical plane, it is not always possible to adjust the thrust to the required value by varying the degree of immersion of the main deflector, because this would undesirably influence the period of swing of the mobile nose. This drawback is eliminated according to the invention by means of a deflector unit of which the main deflector is of adjustable inclination, so that the tangential thrust at each impact is varied without varying the degree of immersion of the secondary deflectors into the jet. This is attained according to the invention by making the main deflector positionable relative to the body of the deflector unit, this positioning being controlled rigidly from the outside, or being adjusted by a spring.

However, the proposed design which solves the main problem arising in this type of irrigator, gives rise to a subordinate problem for which the present invention also provides a solution. In this respect, as the total rotational thrust is constant independent of pressure, and is determined externally as described, the average rotational speed of the irrigator is easily adjusted externally, even with the irrigator operating, merely as a function of the number of impacts of the mobile nose per unit of time, i.e. as a function of the number of times the main deflector interferes with the jet per unit of time.

One drawback of known irrigators is due to the difficulty of setting and stabilising the impact frequency of the jet breaking sector, with the consequence inter alia that the hinging axis of the swinging nose, which is substantially straight, is coplanar with the nose, so that the resisting or return moment set up on the swinging nose by the counterweights with which it is provided at its rear is not proportional to the angle of rotation of the nose, but is inversely proportional thereto. In this respect, as the rotation of the nose increases, the plan projection of the distance between the centre of gravity of the swinging system and the point at which this is hinged to the propelling tube reduces progressively, and consequently in the said cases, the period between two consecutive interferences of the jet breaking sector with the jet varies, and at the same time the impact frequency varies.

To obviate this, various attempts have been made to provide auxiliary counterweights disposed radially differently relative to the path of the swinging system, and which are contacted and/or collected by this latter in intermediate swinging positions. However, these additional devices have not given the desired results, and lead to complicated and costly structures.

To obviate this drawback, the present invention proposes that the swinging system be constituted by a rectangular frame embracing the propelling tube, and suspended below its axis of hinging to the propelling tube, so as to allow a regular and easily adjusted frequency of impact of the jet breaking sector because of the fact that the return moment of the nose is directly proportional to the angle of swing thereof.

In addition, according to the invention the means opposing the swinging of the mobile nose are resilient, and said opposing means are adjustable. Said opposing means can be provided by a spiral torsion spring, and the impacts and consequently the average rotational speed of the irrigator are accelerated by stretching the spring. However, this means that above a certain desired rotational speed, and consequently above a certain frequency of swing of the mobile nose, the necessary spring tension becomes very high, and leads to a violent return of the mobile nose upwards, so making it strike against the propelling tube of the irrigator.

According to the invention, this subordinate drawback is overcome by providing the deflector unit, which as stated comprises a main deflector for impressing the rotational thrust, and a secondary deflector for downwardly thrusting the end of the mobile nose so as to remove the main deflector from the jet, with a further deflector having a very sensitive inclination, which is nearly vertical in the rest position, and arranged to act as a brake during the last portion of the upward swing of the mobile nose, as soon as the deflector unit begins to interfere with the jet, so as to prevent the rear part of the mobile nose from coming into contact with the propelling tube.

The above is inherent in rotary step-by-step irrigators operating over a complete circle, i.e. without a return stroke.

In the case of irrigators which operate over a sector, and thus provided with a to-and-fro movement, the return movement is impressed by a further independent deflector arranged on a lever hinged below the propelling tube, and which rises or falls under the control of the device for reversing the irrigator motion. Thus, said deflector rises from below to interfere with the jet, and generates a reaction thrust which causes rapid return of the irrigator. As this secondary return deflector has a shape such that it is kept within the jet by the same water thrust, in known designs this type of deflector causes a violent downward jet of water. This violent jet of water gives rise to a serious drawback in that the ground which receives it is violently disturbed, often to the extent of uncovering the seeds, tubers or roots of the plants which are being irrigated.

The present invention technically overcomes this drawback by providing a special type of return deflector of lateral discharge type, which besides improving water distribution during return, and thus making the wetting of the ground more uniform in the regions close to the irrigator, prevents the water jet violently striking the ground from above and so causing the said damage. This arrangement also leads to a smoother return stroke.

A further drawback in prior devices is due to the fact that the said device for reversing rotation of the propelling tube is disposed to the side thereof, i.e. outside the vertical plane defined by the axes of the column and propelling tube, because of which it is not possible for the operator to exactly define the end limits of irrigation cover when he wishes to carry out irrigation in the form of circular sectors. This requirement is particularly felt when the radius of operation of the jet is close to roads or buildings. In this respect, because of the said arrangement, the device for reversing rotation of the propelling tube cannot align itself with its connection and disconnection stops located on the upper end of the water feed column.

For this purpose, the invention provides a device for reversing rotation of the propelling tube, which is disposed symmetrically to this latter in that it is housed in its lower region, and its longitudinal axis of symmetry is contained within the vertical plane defined by the longitudinal axes of the propelling tube and of the corresponding column.

The aforesaid device is essentially constituted by a rod, from the rear end of which there branches a lever which engages with the connection and disconnection stops, whereas at its opposite end it is provided with an eccentric device which, when operated, causes a rod to swing in the vertical plane containing this latter, this rod being hinged lowerly to the propelling tube, and its free front end being provided with a scoop for interfering with the jet.

It is apparent at this point that the said symmetry easily allows the operator to exactly define the ends of the sectors to be irrigated, in that the reversal device is coplanar with said vertical plane, and therefore can be aligned with the connection and disconnection stops, so that they exactly define the ends of the sector to be irrigated.

Finally, besides said symmetrical reversal system for the rapid return of the propelling tube, according to the invention the deflector units are made adjustable and interchangeable so as to vary the speed of rotation of the propelling tube.

Further objects and advantages of the invention, together with its operational characteristics and constructional merits, will be further clarified in the detailed description given hereinafter with reference to the figures of the accompanying drawings, which illustrate one embodiment of the irrigator according to the invention, together with various proposed designs for the jet breaking sector, these being given only by way of non-limiting example.

Figure 1:
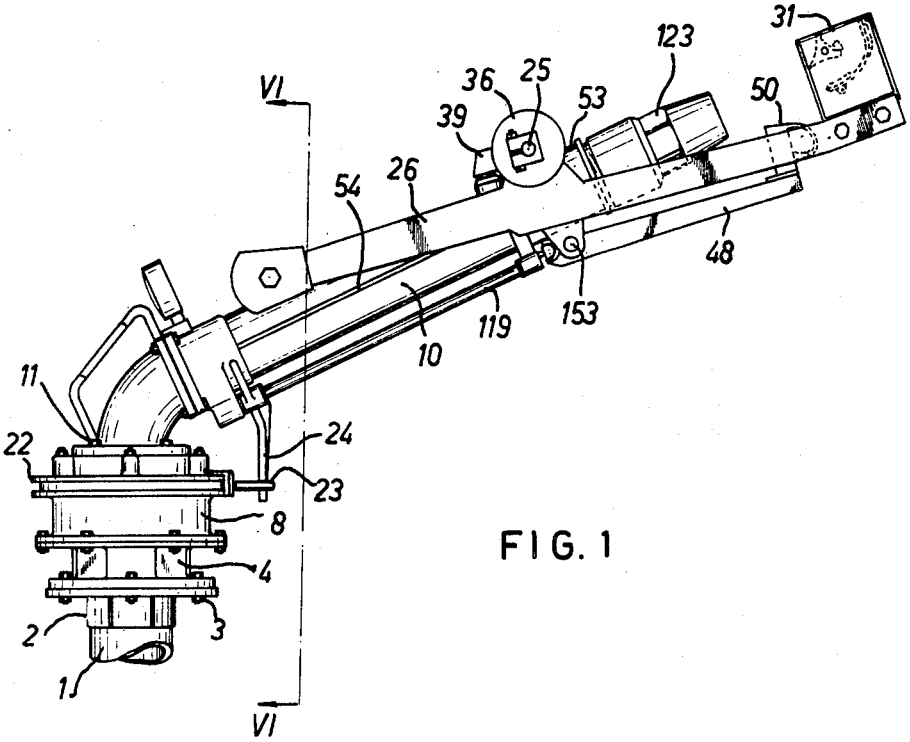
FIG. 1 is a side view of the invention.
Figure 2:
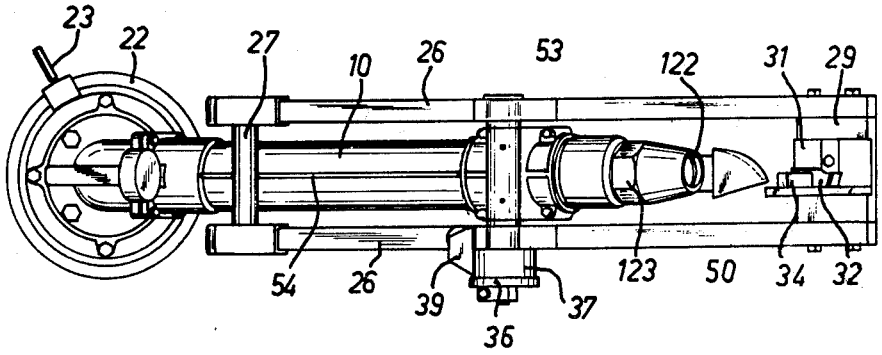
FIG. 2 is a plan view of the invention.

FIGS. 1 to 7 show the vertical fixed column 1 of the irrigator, on to which a flange 2 is screwed. A lower hollow member 4 is fixed to said flange 2 by a set of peripheral bolts 3, and comprises internally a sliding bearing 5 of suitable self-lubricating synthetic material.

A pack of washers and annular seal gaskets 6 is disposed below the sliding bearing 5, but these are not shown in greater detail as they are of normal type.

The lower hollow member 4 supports an upper hollow member 8 at its top, by means of a set of peripheral screws 7.

Figure 3:
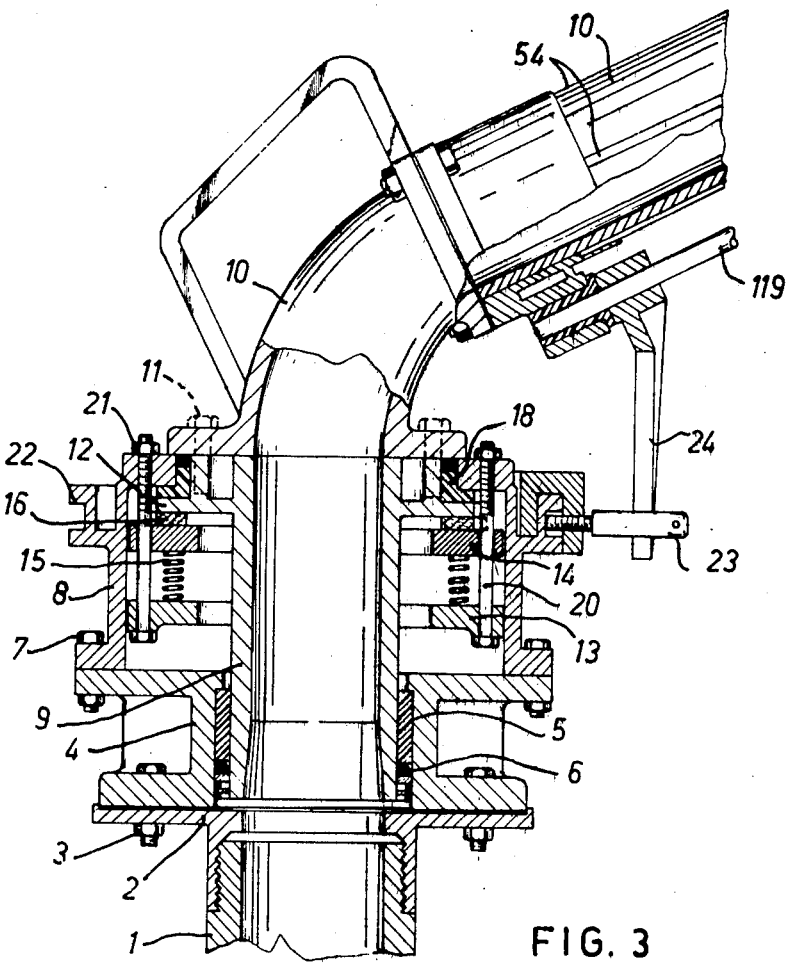
FIG. 3 is a section to an enlarged scale, showing the connection of the rotatable tube to the fixed support column, including the automatically adjustable brake.

Into the sliding bearing 5 is inserted a cylindrical member or sleeve 9, which is fixed at its top to the rotatable tube 10 by four peripheral screws 11, shown in FIG. 3 by dashed lines, because none of them is located in the section plane. The tube 10 is provided with outer ribs 54, the purpose of which is described hereinafter, and carries at its end an interchangeable nozzle 122 locked in position by the ring nut 123. The tubular member 9 comprises an upper flat circumferential contact ring 12.

Inside the hollow member 8 there are disposed, in the order stated, a flat flange 13, a flat flange 14, a set of peripheral springs 15 disposed between these two latter, a ring of friction material 16 resting on the flat flange 14 and provided with projections 17 (see FIG. 4) to prevent its rotation, a collar provided with an annular projection 18 disposed on the flat flange 12 and also provided with projections 19 (see FIG. 4) to prevent its rotation, and a set of circumferential bolts 20 to clamp together the flat flange 13 and an inner ledge on the hollow member 8. The intermediate members 14, 16 and 18 are slidably mounted on said bolts. Said bolts are conveniently locked by the nuts 21. The hollow member 8 also comprises externally a circular shaped guide 22 in which a stop 23 is locked in a suitable circumferential position, to operate the lever 24 which controls the mechanism for reversing the motion of the propelling tube 10. The figures do not specifically show the various seal rings, as these are of normal type.

It is however essential for the sleeve 9 to have an inner diameter equal to the inner diameter of the tube 10, and substantially equal to the inner diameter of the column 1, so that it collects the hydraulic operational thrust of the jet, this thrust obviously acting upwards, and being added to the action of the springs 15 to increase the braking action against the rotation of the member 9, due to the friction between the contact ring 12 and the collar 18.

Figure 8:
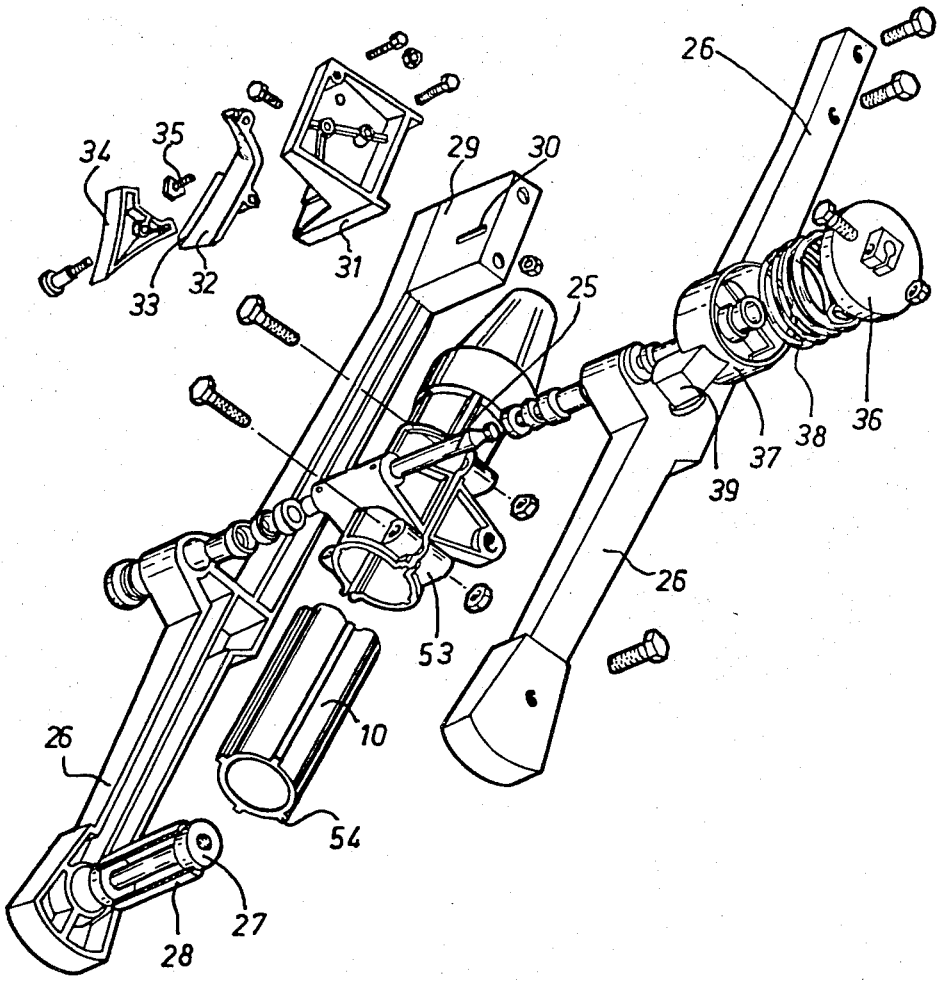
FIG. 8 is an exploded perspective view of the mobile nose, including the deflector unit.

FIGS. 1 and 2, and 8 to 11, with particular reference to FIG. 8, show the mobile nose in detail. Said mobile nose is constituted by a sleeve 53 divided diametrically into two, which can be locked on to the propelling tube 10 in any required position. This is very important in order to be able to adjust the distance between the deflector unit and nozzle as required, and also allows the propelling tube 10 to be replaced by another of a different length, to obtain different hydraulic performance as dictated by specific requirements.

The sleeve 53 is unable to turn on the propelling tube 10 because of the external longitudinal ribs 54 on this latter. The sleeve 53 comprises upperly a swing axle 25 on which two rods 26 swing by way of usual anti-friction means, so that they are lateral to the tube 10. The swing axle 25 is disposed both above the tube and above the lateral rods 26. Said lateral rods 26 are joined at their rear by a cylindrical member 27 with a soft coating 28, and at their front end by a plate 29. Thus a rectangular frame is formed which swings about the axle 25, and encloses the tube 10.

The front plate 29 is provided with a transverse slot 30 for transversely adjusting the deflector unit, according to the diameter of the nozzle mounted on the jet. This deflector unit is constituted, in a preferred embodiment, by a body 31 provided with a vertical wall parallel to the axis of the tube 10.

On said vertical wall is fixed a twisted fin 32 which, at the jet impact section, is orthogonal to the vertical wall and is substantially parallel to the base of the body 31. When inclined upwards into a vertical position, said fin also naturally inclines to the vertical wall of the body 31, namely outwards. The upwardly and outwardly inclined zone of the fin constitutes the actual deflector.

The initial zone of the fin 32 is provided with a projecting edge 33 which maintains a certain flow of liquid on the fin. A substantially triangular or wedge-shaped flapper 34 with concave walls is hinged to the vertical wall of the body 31 above the fin, and can swing between two end positions defined by the stop member 35.

A plate 36 is rigidly fixed to one end of the swing axle 25 and blocked torsionally. On the same axle 25 there is mounted a cylindrical box 37 which is free to rotate about the axle. The plate 36 is connected to the cylindrical box 37 by a torsion spring 38. The box 37 comprises a stop tooth 39 which is arranged to interfere with the swinging of the arm 26.

The main deflector which gives the tangential thrust to the jet is constituted by the fin 32, whereas the secondary deflector which transmits swinging motion to the mobile nose is constituted by the flapper 34, but this always operates in combination with the said fin 32.

Figure 14:
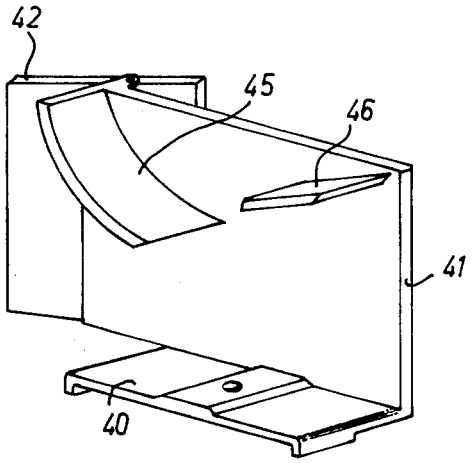
FIG. 14 is a perspective view of a different preferred design of the deflector unit.
Figure 15:
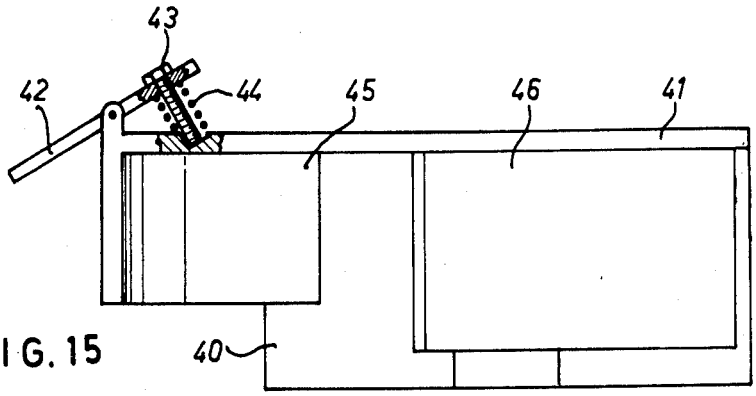
FIG. 15 is a plan view of the deflector unit of FIG. 14.

FIGS. 14 and 15 show a second type of deflector unit for fixing transversely in an adjustable manner to the plate 29. Said second type comprises a flat base 40 from which a flat vertical wall 41 projects parallel to the axis of the liquid jet.

To the rear end of the vertical wall 41 is hinged a fin of adjustable inclination 42, to form the main deflector which transmits the rotational thrust. The position of the fin 42 is defined by a screw 43 acting against a spring 44.

Two further fins 45 and 46 of different inclination project from the wall 41, to form the secondary deflector which transmits swinging motion to the jet.

Figure 12:
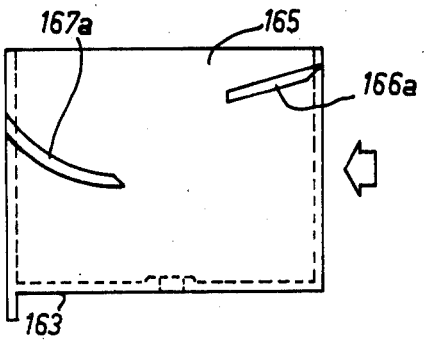
FIGS. 12 and 13 show a side and plan view respectively, of a simplified deflector unit.
Figure 13:
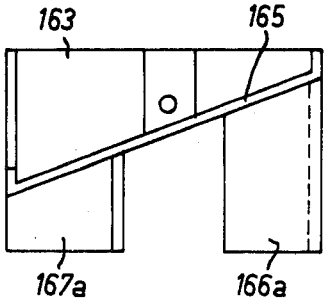

FIGS. 12 and 13 show a simplified deflector unit, in which from the transversely adjustable base 163 there rises a wall 165 inclined to the axis of the jet, to generate the tangential thrust. Two secondary deflectors 167*a* and 166*a* branch orthogonally from said wall, to control the swinging of the mobile nose.

Figure 16:
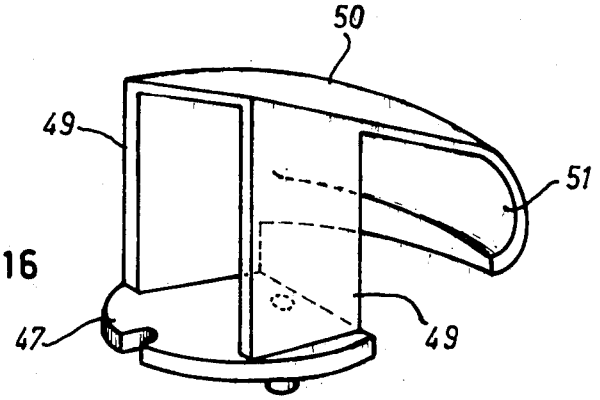
FIG. 16 is a perspective view of the independent deflector which controls the rapid return of the irrigator.
Figure 4:
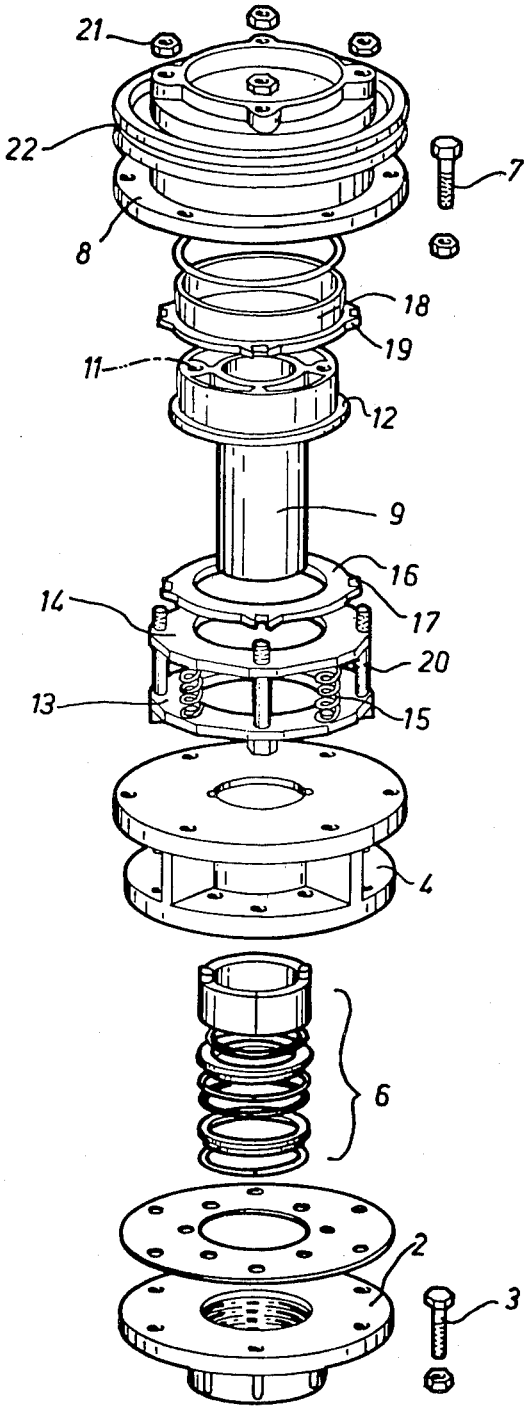
FIG. 4 is an exploded perspective view of said brake.
Figure 5:
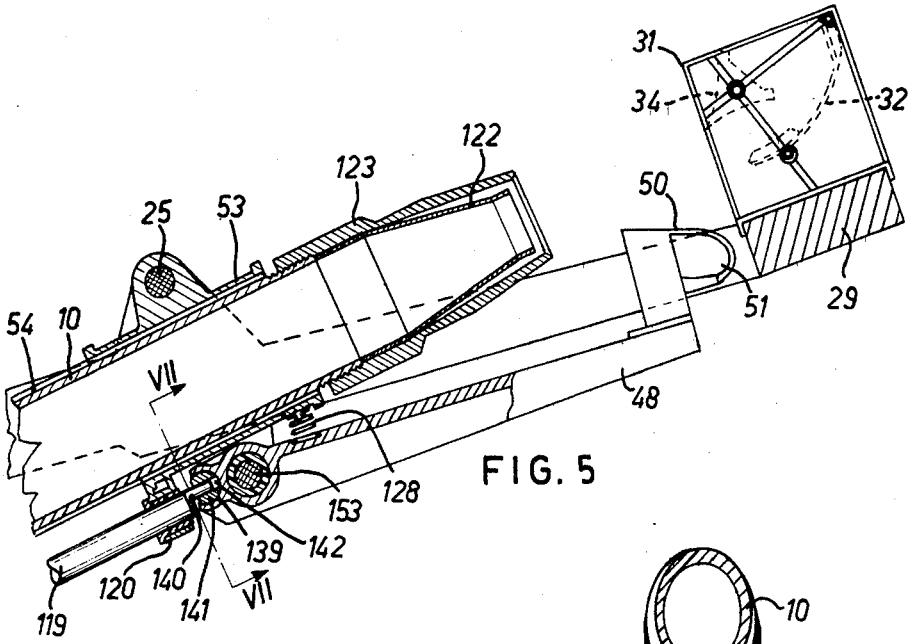
FIG. 5 is a longitudinal section to an enlarged scale, showing the end of the propelling tube, comprising the rapid return reversal device and the mobile nose.
Figure 6:
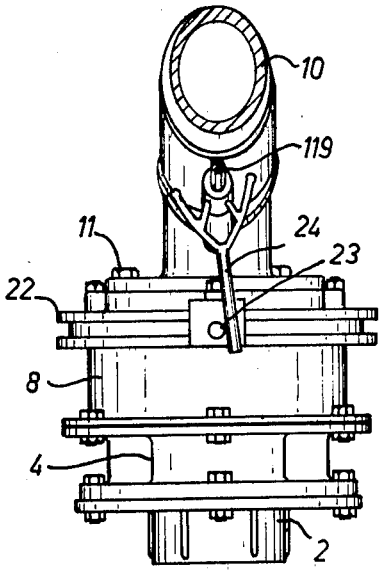
FIG. 6 is a section on the line VI—VI of FIG. 1.
Figure 7:
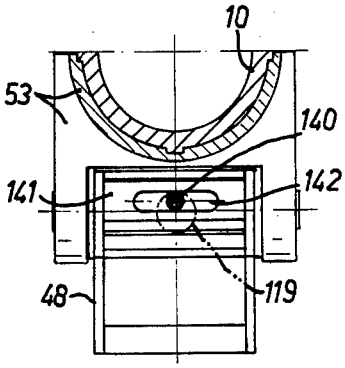
FIG. 7 is a section on the line VII—VII of FIG. 5.

FIG. 16 is a perspective view of the deflector which governs the fast return of the irrigator. Said deflector is constituted by a base plate 47 for fixing to the end of a swinging lever 48 (see FIGS. 1 to 5). The swinging of the lever 48 is controlled by the interference between the stop 23 and the lever 24.

In this respect, the lever 48 swings on a pivot 153 rigid with the sleeve 53 (see FIGS. 1 and 5), the upward swinging of the lever 48 being limited by a spring 128. In a position opposite the pivot 153, the lever 48 comprises a transverse cylindrical seat 139 open rearwards, in which there is a chamfered cylinder 141, which is provided in the chamfer with a seat 142. The pivot 140, which is fixed to the end of the rod 119 in an eccentric position, is inserted and can slide transversely in said seat.

The rod 119 is supported freely rotatable in a bush in the seat 120 rigid with the sleeve 53. At its other end, the rod 119 is supported freely rotatable in a seat rigid with the tube 10. The lever 24 which interferes with the stops 23 branches from the rod 119.

By means of two side walls 49, the plate 47 supports an inclined wall 50 which connects to a discharge channel portion 51 having a curved axis contained in a horizontal plane. The water held between the two walls 49 acts firstly on the wall 50, helping to keep the deflector in the jet, and then discharges along the concave channel portion 51 to generate the tangential return thrust.

Discharge takes place tangentially, so preventing the jet being directed on to the ground.

The operation and adjustment of the improved irrigator are as follows.

The tension of the springs 15 is set by the manufacturer, by means of the bolts 21. The purpose of this setting is to make the overall braking action, which is obtained by means of the ring 12 and the members 18 and 16, a function which is as nearly linear as possible of the operating pressure.

Because of this setting, for a certain predetermined inclination of the main deflector 32, 42 or 165, the jet rotates through a substantially constant angle for each swinging stroke of the mobile nose, starting from an operating pressure of the order of 2 atm. up to pressures of the order of 10 atm. For much higher pressures, a further automatic adjustment is obtained by the deflectors of the type shown in FIGS. 14 and 15, in which the fin 42 can move under the thrust of the water jet, against the spring 44.

With the irrigator set in this manner, the user has only to transversely move the deflector unit, this being made possible by the slot 30 in the plate 29, so as to adapt its position to the diameter of the nozzle used in the irrigator, in accordance with a scale indicated on the plate. The swinging nose and the lever carrying the rapid return deflector can be locked in a swung position, outside the water jet, by a suitable hook or equivalent means such as a latch, not shown.

Obviously, under particular conditions of use, it is always possible to further vary the degree of immersion, or vary the inclination of the deflector unit.

The required average rotational speed on the ground where the device is used is obtained by varying the tension of the spring 38, which is done by rotating the disc 36.

Figure 9:
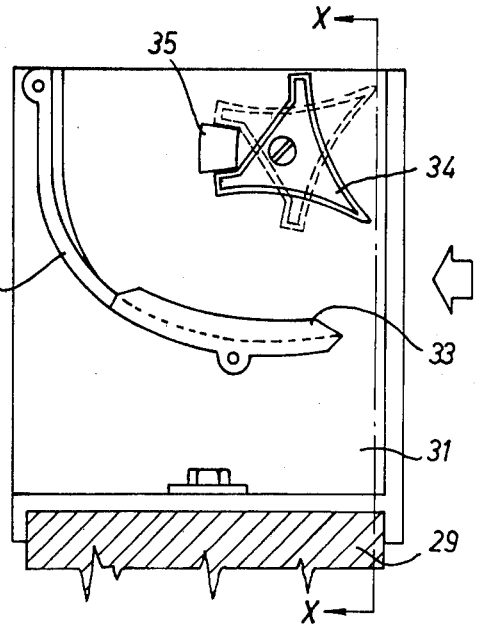
FIG. 9 is a side view of a preferred design of the deflector unit.
Figure 11:
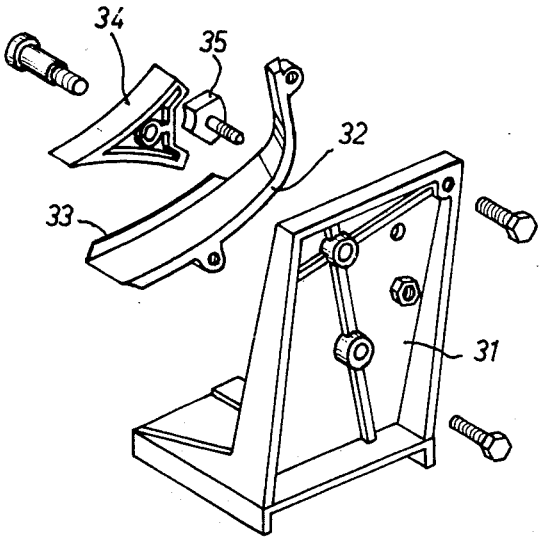
FIG. 11 is a perspective exploded view of the deflector unit of FIG. 9.
Figure 10:
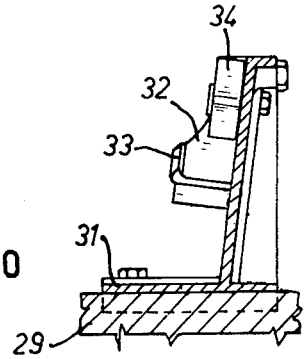
FIG. 10 is a section on the line X—X of FIG. 9.

With the deflector unit illustrated in FIGS. 9, 10 and 11, improved operation under standard conditions in generally obtained, in that, as stated, it is adjusted such that the vertical wall parallel to the axis of the jet is substantially tangential thereto.

In this manner, because of the projecting rib 33, there is a certain predetermined flow which acts on the fin 32 both in the plane of swing and in the orthogonal plane. This makes it possible to keep the shape of the fin 32 fixed.

Under exceptional conditions, e.g. with insufficient pressure, acceptable operation is obtained with the deflector unit illustrated in FIGS. 14 and 15, which, as is apparent, both enables the degree of immersion of the secondary deflectors to be varied, and the degree of immersion and inclination of the main deflector 42 to be adjusted either separately or together.

A supplementary adjustable deflector such as 42 can also be fitted to the deflector unit of FIGS. 9, 10 and 11, and said deflector of type 42 can either be rigid with the common plate of the deflector unit, or can branch from a separate plate fixable separately to the base 29.

These two methods are not shown, as they are obvious to experts of the art.

The operation of the deflector unit illustrated in FIGS. 9, 10 and 11 will now be described in connection with the braking action and return swing of the swinging unit, directed towards preventing the rear end thereof from violently striking the tube. Referring to the situation which occurs when the deflector unit rises towards the jet while the mobile nose is still substantially inclined, the nearly vertical portion of the deflector 32 firstly interferes with the jet, to brake the rise of the deflector unit, and then prevents the rear end of the mobile nose from striking the propelling tube. This occurs until the jet interferes with the flapper 34, which returns the mobile nose upwards for the last part of its stroke, and, swinging into an opposing position, immediately thrusts it downwards in combination with the first shaped portion of the deflector 32.

Besides solving the said technical problems and overcoming the said drawbacks, the improved irrigator heretofore described offers a large number of secondary advantages under abnormal or emergency operating conditions. In fact, zones close to the irrigator or at a great distance from the irrigator can be selectively wetted by varying the period of swing from very short to very long, and consequently adjusting the thrust by adjusting the deflector, to keep the rotational speed at the value required.

In all cases, sufficiently uniform wetting of the ground is ensured both in zones close to and distant from the irrigator.

Both the field of application of the irrigator and its effectiveness are greatly improved over known irrigators.

The invention is not limited to the single embodiment heretofore described, and modifications and improvements can be made thereto without leaving the scope of the following claims.

What I claim is:

1. In a step-by-step irrigator, of the type comprising a column, a propelling tube rotatable relative to said column, a torsional brake between said column and said tube, said propelling tube including a laterally extending portion for directing a jet of water along an outward path relative to said column, an impulse arm assembly having a nose, deflector means on said nose, means mounting said impulse arm assembly on said propelling tube for periodic swinging movement between a first position in which a stop on said arm engages a stop on said tube and said deflector means at the nose is in the path of the water jet, and a second position in which the deflector means is spaced from the water jet path, said deflector means being of the type in which the rotational thrust exerted on the tube increases with increased water pressure, and return means for returning the arm toward said first position, a rapid return deflector disposed at the end of a lever lying below the laterally extending portion of the propelling tube, which rises into and lowers below the jet under the action of a mechanism for reversing the rotational direction of motion of the tube, the improvements comprising, in combination, means for automatically adjusting the braking of the rotation of the rotatable tube to increase the braking in response to increased pressure of the water at the propelling tube, and means for adjusting the period of swing of the swinging mobile nose, said deflector means comprising double acting deflector means for swinging the arm in response to impingement thereon by the water jet to move said arm toward said second position, and to arrest said swing during the return movement toward said first position when the stop on said arm is close to colliding with the stop on said propelling tube.

2. An irrigator as claimed in claim 1, wherein said means for automatically adjusting the braking of the rotatable tube comprises a coupling between the rotatable propelling tube and the column, constituted by a hollow member fixed to the column and provided with an internal upper annular projection, a rotatable sleeve fixed to the propelling tube and contained within said annular projection and provided at its top with an external annular projection which mates with the bottom of the internal annular projection of the hollow member, at least one support bearing for the sleeve inside the hollow member, at least one friction washer disposed between the two said external and internal mating annular projections, and externally adjustable resilient means for adjusting the pressure between said two annular projections as required.

3. An irrigator as claimed in claim 2, wherein the hollow member supports on its inside, by means of bolts, a flange which embraces the sleeve, a ring supported by way of a circumferential set of springs on said flange, the ring also resting against the external annular projection on the sleeve by way of a friction ring.

4. An irrigator as claimed in claim 1, wherein the means for adjusting the period of swing of the mobile nose comprise:

a mobile fitting constituted by a rectangular frame which embraces the propelling tube and swings below an axle rigid with the propelling tube lying along the axis of the frame;

adjustable means for resiliently returning said rectangular frame to its rest position;

a deflector unit disposed at the end of the swinging frame and comprising at least one deflector which can be positioned in such a manner as to thrust said end downwards under the action of the jet, and another deflector which can be positioned in such a manner as to arrest the upward stroke of said end, again by action of the jet, before the mobile frame collides against the propelling tube.

5. An irrigator as claimed in claim 4, wherein said rectangular swinging frame comprises at its front end a plate on which said deflector unit is fixed in such a manner that its position can be adjusted both transversely and angularly, and comprises:

a vertical wall parallel to the axis of the propelling tube, a fin which is twisted between an inlet section perpendicular to the vertical wall and parallel to the axis of the propelling tube, and an outlet section inclined upwards and forwards relative to the plane of the vertical wall, a projecting edge in the initial portion of said fin, said another deflector comprised of triangular shape supported above said fin by a pivot orthogonal to said vertical wall.

6. An irrigator as claimed in claim 4, wherein said swinging frame comprises at its front end a plate on which said deflector unit is fixed in such a manner that it can be adjusted both angularly and transversely, and comprising:

a vertical wall parallel to the axis of the propelling tube, a pair of fins, one of which is flat and inclined downwards and the other curved and inclined upwards, both branching from said wall, a deflector portion hinged to the front edge of the vertical wall and of adjustable inclination relative to said wall by means of an adjustment device constituted by at least one screw and at least one spring.

7. An irrigator as claimed in claim 4, wherein said rectangular swinging frame comprises at its front end a plate on which said deflector unit is fixed in such a manner that it can be adjusted both angularly and transversely, and comprising:

a vertical wall cutting the axis of the propelling tube, a pair of fins, one of which is flat and inclined downwards and the other curved and inclined upwards, both branching from said wall.

8. An irrigator as claimed in claim 4, wherein said rectangular swinging frame comprises at its front end a plate on which said deflector unit is fixed in such a manner that it can be adjusted both angularly and transversely, and comprising:

a vertical wall parallel to the axis of the propelling tube, and provided with a fixed front edge inclined to the axis of the propelling tube, a pair of fins, one of which is flat and inclined downwards and the other curved and inclined upwards, both branching from said wall.

9. An irrigator as claimed in claim 4, wherein the return means for the mobile nose are constituted by an externally adjustable spring under torsional stress.

10. An irrigator as claimed in claim 9, wherein the irrigator rapid return deflector comprises a downwardly inclined wall for urging the deflector into the water jet, and which is connected at its front to a channel shaped curved portion having its axis contained in a plane parallel to the axis of the propelling tube, the shaped portion being transmitting the rotational reaction thrust to the irrigator without directing water towards the ground, the water being substantially propelled laterally.

11. An irrigator as claimed in claim 1, wherein the mobile nose is fixed to a member which can be adjusted axially along the propelling tube and is rotationally blocked by at least one external longitudinal rib provided thereon.

12. An irrigator as claimed in claim 1, wherein the lever below the propelling tube and supporting the rapid return deflector extends from a control rod, the axis of which is contained in the plane defined by the axes of the propelling tube and the support column therefor.

* * * * *